United States Patent [19]

Okayama

[11] 4,193,164

[45] Mar. 18, 1980

[54] REAR HINGE FOR HOLDING LID OF RECORD PLAYER TO CONSOLE

[75] Inventor: Hirohumi Okayama, Yokohoma, Japan

[73] Assignee: Kato Electric and Machinery Co., Ltd, Kanagawa, Japan

[21] Appl. No.: 909,011

[22] Filed: May 24, 1978

[30] Foreign Application Priority Data

Jun. 10, 1977 [JP] Japan ..... 52-76287[U]

[51] Int. Cl.[2] ..... E05D 11/08

[52] U.S. Cl. ..... 16/141; 16/142; 16/144; 16/145; 16/DIG. 13; 220/335

[58] Field of Search ..... 16/141, 145, 180, 188, 16/DIG. 13, 142, 144; 220/335

[56] References Cited

U.S. PATENT DOCUMENTS

| | | | |
|---|---|---|---|
| 935,611 | 9/1909 | Perkins | 16/141 |
| 3,082,865 | 3/1963 | Nemsky | 220/335 X |
| 3,346,309 | 10/1967 | Mellion | 16/141 X |
| 3,566,418 | 3/1971 | Carlson et al. | 16/145 |

FOREIGN PATENT DOCUMENTS

| | | | |
|---|---|---|---|
| 2,423,007 | 11/1975 | Fed. Rep. of Germany | 16/141 |

*Primary Examiner*—Werner H. Schroeder
*Assistant Examiner*—Moshe I. Cohen
*Attorney, Agent, or Firm*—George B. Oujevolk

[57] ABSTRACT

A rear hinge arrangement for holding the lid of a record player to the console. A lock plate is affixed to the rear top portion of the console, said lock plate having a defined receptacle portion to receive and hold an insert component of an attaching member of the rear hinge. The attaching member has the aforementioned insert component held in place by the lock plate receptacle portion, and, an outer section extending out of the receptacle. On said attaching member are a pair of first and second side plates, said side plates have juxtapositioned a first set of opposite axial apertures. Pivotally joined to the attaching member is a rectangular supporting member with a pair of second side plates likewise with a pair of juxtapositioned opposite axial apertures which are positioned alongside the first side plates in axial alignment therewith. At the rear of the supporting member is a hollow receiving portion for receiving and holding a lid. A hinge pin passes through said first and second sets of apertures with weak spring means disposed around the hinge pin, engaging the supporting member, biasing the supporting member towards an open position. In at least one of the side plates of the first and second pairs of side plates which are adjacent to each other are matching concave or convex rescesses.

7 Claims, 9 Drawing Figures

REAR HINGE FOR HOLDING LID OF RECORD PLAYER TO CONSOLE

BACKGROUND OF THE INVENTION

This invention relates to a rear hinge of a lid, in particular to a rear hinge of a lid or cover for a record player and the like.

BRIEF DESCRIPTION OF THE PRIOR ART

Recently, the lid or cover of the record player, the phono tape recorder and the video tape recorder has been made of glass or plastic and shaped in a square. As the lid or cover may sometimes be only partly open, about 30° when playing a record, the rear hinge must be able to hold the cover at this half-open position. Lids and covers of the prior art had considerable weight and a metal hinge is used for the lid or cover to attain a smooth opening and closing, the hinge must be strong and durable. In fact, a metal hinge made of iron plate or steel is usually used for the lid or cover.

The construction of the conventional metal hinge generally comprises an attaching member fixed to an upper rear portion of the console and a supporting member fixed to the dust guard cover. The supporting member and the attaching member are pivotally connected by a hinge pin provided with a coil spring or leaf spring. According to the prior art, the dust guard cover is held in the half-open position by a friction member or a resilient means used in the rear hinge of a record player.

The rear hinge of the prior art which is made of a metal material is expensive owing to a plating applied to the material of the hinge as well as the material itself. Also, because of the metal hinge being made by a press, the design or shape of the hinge is limited. Usually, the rear hinge is made of a thick material so as to obtain the necessary strength and toughness, so that it is rather heavy.

The conventional metal rear hinge can not hold the dust guard cover of the record player at its half-open position reliably, so that the cover is apt to shut or fall down when a small shock or vibration is applied to the cover or the console to which the cover is attached.

There are also times when the rear hinge cannot shut the cover completely owing to the resiliency of the spring because the spring must have a torque corresponding to the weight of the cover in order to hold the cover in a half opened position, and, when vibration is applied to the cover it opens partly because of the poor performance of the friction member.

OBJECTS OF THE INVENTION

An object of the invention is to provide a rear hinge of a record player which is made economically, of any desired shape so as to obtain various designs.

Another object of the invention is to provide a rear hinge of a record player in which the shortcomings hereinbefore mentioned are eliminated and particularly the cover is firmly held at a predetermined open angle.

Other objects and advantages of this invention will be apparent from the following description when taken in conjunction with the drawing in which,

DETAILED DESCRIPTION

Figure 1:
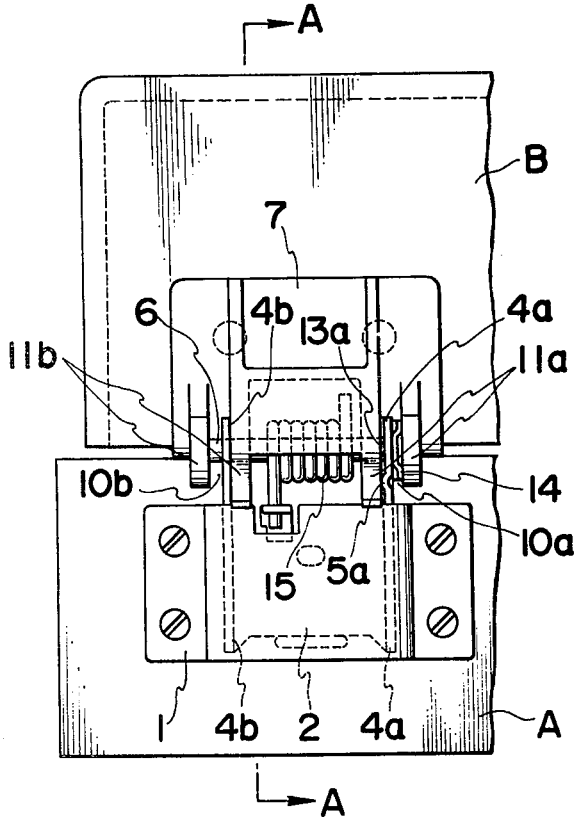
FIG. 1 is a front view of the rear hinge according to an embodiment of the present invention when the dust guard cover is closed.
Figure 2:
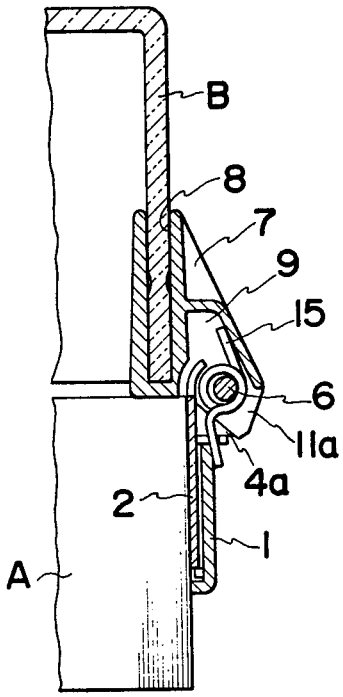
FIG. 2 is a sectional view taken along a line A—A of FIG. 1, FIG. 3 (A) is a side elevational view showing a supporting member of the present invention, FIG. 3 (B) is an enlarged side elevational view showing a part of the supporting member, FIG. 4 (A) shows a side view of an attaching member according to the present invention, FIG. 4 (B) is a partly enlarged front view of the attaching member.
Figure 3A:
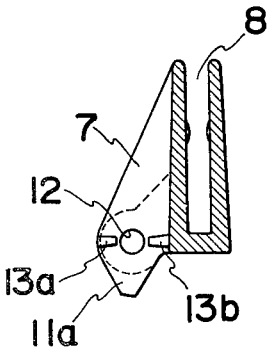
Figure 3B:
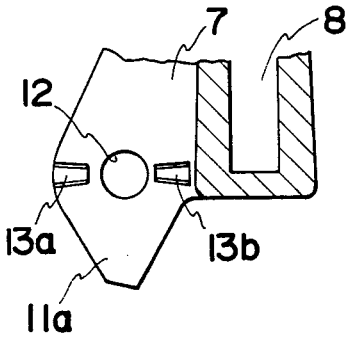

As seen in the accompanying drawings of FIG. 1 to FIG. 5, a rear hinge according to one embodiment of this invention has an attaching member 2 which is detachably inserted to a lock plate 1 fixed to a rear upper portion of a console or cabinet A of a record player. The rear hinge of the present invention also has a supporting member 7 made of plastic, the supporting member 7 is pivotally connected to the attaching member 2 through a hinge pin 6. The attaching member 2 has a pair of upright extending side plates **4*a* and 4*b*. The side plates 4*a* and 4*b* have a through hole 3. A pair of convex portions 5*a* and 5*b* are formed on opposite sides of one of the side plates 4*a*** so as to be diametrically opposite each other.

Figure 4A:
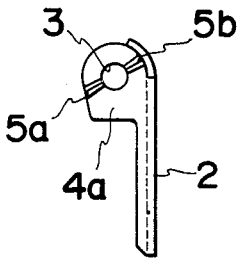
Figure 4B:
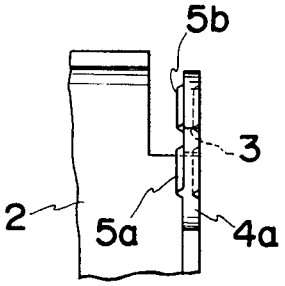
Figure 5:
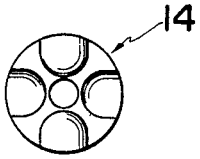
FIG. 5 is a plan view of a washer used of the present invention.

The convex portion **5*a* extends at an angle of declination of 30° from the horizontal center line through the through hole 3 and the convex portion 5*b* extends at an angle of elevation of 30° from the horizontal diameter through the through hole 3 as shown in FIG. 4** (A).

The supporting member 7 has a hollow receiving portion 8 and two pairs of side plates **11*a* and 11*b* which extend down from the hollow receiving portion 8. The side plates 11*a* and 11*b* have an aperture 12, the apertures in each of the side plates being axially aligned so that a hinge pin 6 can be passed therethrough. A coil spring 15 is wound around the hinge pin 6. The side plates 11*a* and 11*b* are provided with vertical grooves 10*a* and 10*b* thereon. The supporting member 7 having the supporting hollow portion 8 and the side plates 11*a* and 11*b* is made integrally of plastic, for example of polyacetal. On the side face of the side plate 11*a* or 11*b* facing to 5*a* and the concave portion 5*b* formed on the side plate 4*a* of the attaching member 2, convex portions 13*a* and 13*b* are formed so as to extend horizontally and diametrically on both sides of the aperture 12, i.e., the convex portions 13*a* and 13*b* are arranged opposite each other, on both sides of the aperture 12. The pair of convex portions 13*a* and 13*b* correspond in location to the similar pair of convex portions 5*a* and 5*b* formed on the side plate 4*a* of the attaching member 2 when the lid is opened about 30°. A spring washer 14 which has an aperture is inserted in a vertical groove 10*a* for biasing the pair of convex portions 5*a* and 5*b* formed on the side plate 4*a* toward the pair of convex portions 13*a* and 13*b*** of the side plate 11*a*. The hinge pin 6 is inserted in apertures 3, 12, and 14*a* of the side plates 4*a*, 4*b*, 11*a*, 11*b* and spring washer 14.

The coil spring 15 which is wound around the hinge pin 6 is interposed between the supporting member 7 and the attaching member 2 for biasing the supporting member 7 in a clockwise direction. The coil spring 15 naturally has a torque smaller than that caused by the weight of the cover B.

According to the first embodiment of the present invention, the convex portions 5*a* and 5*b*, 13*a* and 13*b* are formed on the side plates 4*a* and 11*a*. When one pair of convex portions 5*a* and 5*b* does not correspond to another pair of convex portions 13*a* and 13*b*, the biasing force of the spring washer 14 does not function so strongly, so that the friction force between the side plates 4*a* and 11*a* is weak.

In case that either of the convex portions 5*a*, 5*b* or the convex portions 13*a*, 13*b* are made of a concave shape, the remaining convex portions contact the side plates in a point contact, attaining rather a small friction resistance. When the spring washer 14 is used a small friction resistance is obtained and when a ring of hard rubber is used instead of the spring washer 14 a much larger resistance is obtained.

According to an endurance test of the supporting member 7 made of polyacetal, to which the dust guard cover B is fixed and the force of the coil spring 15 is applied, no damage or crack took place in the material of the supporting member after opening and closing movements of over 10000 times. As hereinbefore described, the supporting member 7 can be manufactured automatically in large quantities after a mold for the member is produced. Additionally, the plastic employed to make the supporting member 7 is considerably lower in cost than steel material. As a result, the rear hinge of the present invention is obtained at very economical cost. If necessary, employing plastic causes improvement of a design or shape of the hinge and is applied to either or both of the supporting member 7 and the attaching member 2.

For the purpose of giving those skilled in the art a better understanding of the invention, the following explanation is given:

When the dust guard cover B is opened in order to operate the record player the cover B is opened smoothly with the help of the resilient force of the coil spring 15 without working against the full weight of the cover B.

During the progress of the raising or opening movement of the cover B, the convex portions 13*a* and 13*b* formed on the side plate 11*a* of the supporting member 7 abut against the convex portions 5*a* and 5*b* formed on the side plate 4*a* of the attaching member 2, so that a small resistance of movement is felt by an operator.

With further progress of the movement of the cover B, the convex portions 13*a* and 13*b* ride over other convex portions 5*a* and 5*b*. Then, the cover B is stably held at the half-open position owing to an engagement of the convex portions 5*a* and 13*a* pressed together by the spring washer 14 and the torque of the coil spring 15 biasing the cover to the open position. The half-open position of the cover B therefore is not changed even if there is a great deal of shock or vibration. The stable half-open angle of the dust guard cover B is about 30° and also the angle of the pair of convex portions 5*a* and 5*b* to the horizontal is about 30°. Of course, the stable half-open angle of the cover B can be freely selected by selecting angles of the convex portions 5*a*, 5*b* or 13*a*, 13*b*.

When the force of the coil spring 15 is made stronger or selected properly, the cover B can be freely stopped at any angular positions and balanced with the force of the coil spring 15 without the convex portions 5*a*, 5*b* and 13*a*, 13*b* formed on the side plates. In this condition, of course, the half-open position of the cover B is not always held stably.

When the dust guard cover B is further opened and it reaches a fixed opening angle of about 70°, the cover is stably held by a stopper means (not shown) conventionally mounted on the record player.

If necessary, the cover B is removed from the console A by holding the cover B with the hands and pulling it so as to remove it from the supporting hollow cavity 8. Of course, the dust guard cover B can be easily mounted and supported on the console A by lightly pushing the lower edge of the cover B onto the supporting cavity 8 of the supporting member 7. According to the embodiment of the present invention, the convex-concave portions are formed on the inner surface of the supporting hollow cavity 8, so that the dust guard cover B is held in its fixed position.

As described above, the dust guard cover B is removed from the stereo record player console A and therefore the fragile console A made of plastics and the console B are separately and respectively packed. Only the fragile cover B can be packed in a particular protective condition and transported carefully.

When the cover B is closed on the console A and progresses toward its flat position, the convex portions 13*a* and 13*b* formed on the supporting member 7 again with the convex portions 5*a* and 5*b* formed on the attached member 2 at the opposite sides so that the cover B is stably held at the half-opened position.

When the cover B is pushed further portions 13*a* and 13*b* again ride over other convex portions 5*a* and 5*b* and finally the cover reaches its complete closed position or flat condition. As the cover B approaches its closed position on the console A, the cover B progresses smoothly and slowly owing to the resiliency of the coil spring 15 mounted around the hinge pin 6.

Even though shock and vibration are applied to the coil spring 15 and the coil spring 15 energized by the shock and vibration causes the cover to be raised a small distance, the cover B falls back promptly to its flat position owing to the weight of the cover.

According to another endurance test of the convex portions 13*a* and 13*b* formed on the cover supporting member 7, they are not worn out or cracked after the movement of the supporting member 7 over 10000 times. The convex portions 13*a* and 13*b* have retained their functions substantially after the reciprocating motion of the cover supporting member 7 over 10000 times.

Figure 6:
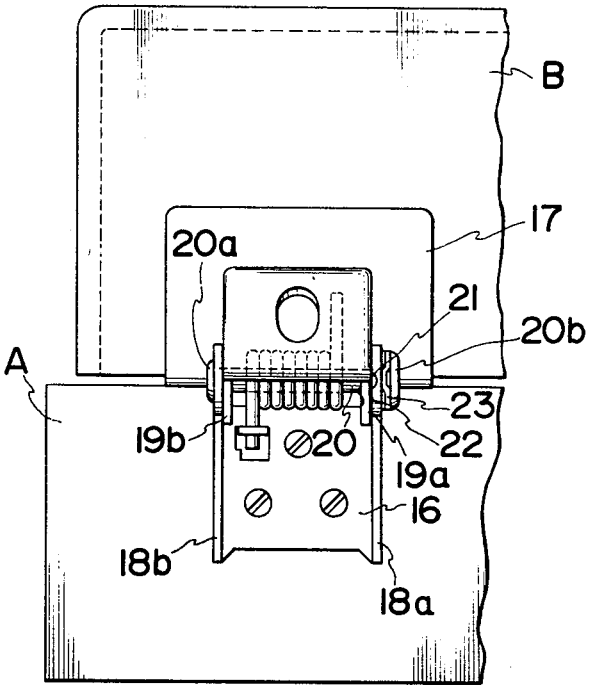
FIG. 6 shows a front view of another embodiment of the rear hinge according to the present invention.
Figure 7:
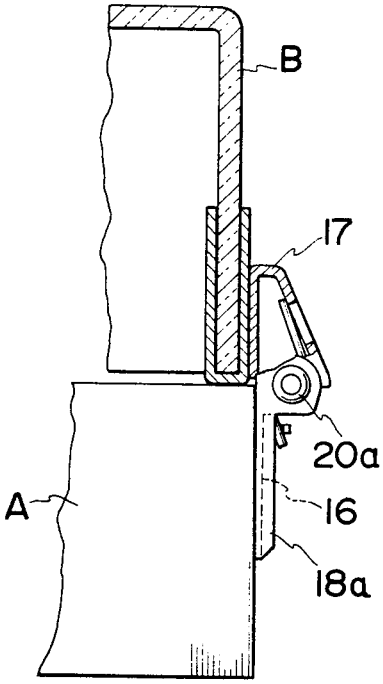
FIG. 7 is a partly sectional side view of the rear hinge of second embodiment according to the present invention.

FIGS. 6 and 7 of the drawing show another embodiment of the present invention, in which there is an attaching member 16 and a supporting member 17 corresponding to the attaching member 6 and the supporting member 7 shown in FIGS. 1 to 4. The attaching member 16 and the cover supporting member 17 are made of metal material such as of iron plates and they are pressed to form a generally inverted "C" shaped in section.

The attaching member 16 has a pair of side plates 18*a* and 18*b* and the cover supporting member 17 has a pair of side plates 19*a* and 19*b*. The side plates 18*a*, 18*b* and 19*a*, 19*b* are in contact with each other as shown in FIG. 6, and the attached member 16 and the cover supporting member 17 are pivotally connected to each other by means of a hinge pin 20 having a projecting end 20*a* and a head 20*b*.

A concave portion 21 is formed on either of the side plates 18*a* and 19*a* and a convex portion 22 is formed on another one of the side plates 18*a* and 19*a*, and the concave portions 21 and the convex portions 22 are in engagement with each other. Between the head 20*b* of the hinge pin 20 and the side plate 18*a* is resilient member 23 through which the hinge pin 20 passes.

The function, arrangement and extending angle of the concave portions 21 and convex portions 22 are the same as these of the convex portions 13*a* and 13*b*. The concave portions 21 and convex portions 22 are made of metal and therefore they are not apt to wear-out due to abrasive motions of the concave portions 21 and convex portions 22. Of course, either the concave portions 21 and convex portions 22 can be made in convex shape to attain more effective engagement of the convex portions.

As seen in the second embodiment of the present invention, the supporting member 17 corresponding to the supporting member 7 of the first embodiment has a cavity in which a lower edge of the dust guard cover B is inserted and supported firmly in place.

Thus, the cover B can be opened almost without effort owing to a coil spring wound around the hinge pin 20. When the concave portion 21 is made as a convex portion and the convex portion 22 is made as a concave portion and both the portions are engaged or fitted to each other, the dust guard cover B is held in the half-open position. Even though considerable strong shock and vibration are applied to the cover B or the console A, the cover B is held firmly at its slanted condition and its flat closed condition.

According to the present invention, a weak coil spring of little force is sufficient and wound around the hinge pin 6 or 20 to hold the cover B firmly at a half-open position and at a flat closed position. Also the coil spring on the hinge pin 6, provides an effective engagement of the convex or concave portions on the side plates of the first and the second embodiments of the present invention and allows cover B to be held firmly at both the inclined and horizontal positions.

It is to be understood that the embodiments of the present invention shown are merely illustrative of a preferred embodiments, and that such changes may be made as come within the scope of the following claims.

I claim:

1. A rear hinge arrangement for holding the lid of a console, said console having a lock plate (1) affixed to the rear top portion thereof and said lock plate (1) having a defined receptacle portion to receive and hold a component of an attaching member of the rear hinge, said rear hinge comprising in combination:

(a) an attaching member (2) with an insert component designed to enter and be held by the defined receptacle portion of a lock plate (1), and, an outer section extending out of said receptacle portion, a pair of first and second side plates (4*a*, 4*b*) on said attaching member (2), and extending at least from said outer section, said side plates (4*a*, 4*b*) having a juxtapositioned first set of opposite axial apertures;

(b) a rectangular supporting member (7) with a defined rear part, including a pair of second side plates (11*a*, 11*b*) likewise with a pair of juxtapositioned opposite axial apertures, for positioning alongside said first side plates in axial alignment therewith, and, a hollow receiving portion (8) in said rear part, for receiving and holding a lid;

(c) a hinge pin (6) passing through said first and second sets of apertures, weak spring means (15) disposed around said hinge pin (6) and engaging said supporting member (7) biasing said supporting member (7) towards an open position; and, (d) matching concave or convex recesses (5*a*, 5*b*, 13*a*, 13*b*) in at least one of the side plates of the first pair of side plates (4*a*) and the one of the pair of the second side plates (11*a*) adjacent to the one side plate of the first pair of side plates (4*a*), said recesses extending radially on diametrically opposite sides of said first and second apertures at an angle to the horizontal corresponding to an angle at which the console lid is to remain partly open.

2. A hinge as claimed in claim 1, said recesses being on both said first and second pairs of side plates on each plate thereof.

3. A hinge as claimed in claim 2, including a spring washer (14) on said hinge pin (6) disposed for urging said one of the first pair of side plates and said one of the second pair of side plates into contact so that said recesses should hold when engaged.

4. A hinge as claimed in claim 3, at least one of the pair of the second side plates (11*a*) having a vertical groove (10*a*), said hinge (14) having a corresponding boss portion for engaging said groove (10*a*).

5. A rear hinge arrangement attached to the rear top portion of a console to the lid thereto, comprising in combination:

(a) an attaching member (16) for attaching the hinge to the rear top portion of the console, said attaching member (16) having a pair of first and second side plates (18*a*, 18*b*), said side plates having a juxtapositioned first set of opposite axial apertures;

(b) a rectangular supporting member (17) with a defined rear part, including a pair of second side plates (19*a*, 19*b*) likewise with a pair of juxtapositioned opposite axial apertures, for positioning alongside said first side plates in axial alignment therewith, and, a hollow receiving portion (8) in said rear part, for receiving and holding a lid;

(c) a hinge pin (6) passing through said first and second sets of apertures, weak spring means (15) disposed around said hinge pin (6) and engaging said supporting member (17) towards an open position;

(d) matching concave or convex recesses in at least one of said side plates of the first pair of side plates and corresponding concave or convex recesses in the corresponding one of the pair of the second side plates adjacent to the one side plate of the first pair of side plates, said recesses extending radially on diametrically opposite sides of said first and second apertures at an angle to the horizontal corresponding to the angle at which said console lid is to remain partly open; and, (e) bias means on said hinge pin (6) urging the respective side plates with said recesses into contact to hold said lid partly open.

6. A hinge as claimed in claim 5, said bias means including a projecting end (20*a*) and a head on said end (20*b*), a spring washer on said hinge pin cooperating with said head (20*b*).

7. A hinge as claimed in claim 6, wherein one of said recesses is concave and the other is convex.

* * * * *